US009433561B2

(12) United States Patent
Rubinstein

(10) Patent No.: US 9,433,561 B2
(45) Date of Patent: Sep. 6, 2016

(54) CRIB BABY BOTTLE HOLDER FOR SELF FEEDING

(71) Applicant: Allen Rubinstein, Brooklyn, NY (US)

(72) Inventor: Allen Rubinstein, Brooklyn, NY (US)

( * ) Notice: Subject to any disclaimer, the term of this patent is extended or adjusted under 35 U.S.C. 154(b) by 0 days.

(21) Appl. No.: 14/589,965

(22) Filed: Jan. 5, 2015

(65) Prior Publication Data

US 2015/0108291 A1 Apr. 23, 2015

Related U.S. Application Data

(63) Continuation-in-part of application No. 13/623,092, filed on Sep. 19, 2012, now Pat. No. 8,925,876.

(60) Provisional application No. 61/538,927, filed on Sep. 25, 2011.

(51) Int. Cl.
*A47D 15/00* (2006.01)
*A61J 9/06* (2006.01)

(52) U.S. Cl.
CPC ..... *A61J 9/06* (2013.01); *A61J 9/0661* (2015.05); *A61J 9/0638* (2015.05); *Y10T 29/49826* (2015.01)

(58) Field of Classification Search
None
See application file for complete search history.

(56) References Cited

U.S. PATENT DOCUMENTS 2,711,872 A * 6/1955 Lampke ..... 248/103
2,733,710 A * 2/1956 Zibel ..... 126/263.01
4,062,510 A * 12/1977 Brochu ..... 248/102
4,114,847 A * 9/1978 Bogensberger ..... 248/104
4,399,668 A * 8/1983 Williamson ..... 62/457.4
4,405,106 A * 9/1983 Adler ..... 248/102
4,718,623 A * 1/1988 McClure ..... 248/102
4,802,602 A * 2/1989 Evans et al. ..... 220/739
4,946,119 A * 8/1990 Hellhake ..... 248/102
4,957,254 A * 9/1990 Hill et al. ..... 248/207
4,989,811 A * 2/1991 Millis et al. ..... 248/104
5,192,041 A * 3/1993 Bryant ..... 248/104
5,325,991 A * 7/1994 Williams ..... 220/739
5,356,107 A * 10/1994 Sinohuiz ..... 248/311.2
5,397,039 A * 3/1995 Parcelles ..... 224/148.5
5,409,190 A * 4/1995 Mattox ..... 248/315
5,582,335 A * 12/1996 Beard et al. ..... 224/148.5
5,603,479 A * 2/1997 Kristy ..... 248/548
5,622,346 A * 4/1997 Story, Jr. ..... 248/311.2
5,664,746 A * 9/1997 Benzakarya ..... 248/106
5,695,162 A * 12/1997 DiCastro ..... 248/231.81
5,704,505 A * 1/1998 Singh ..... 215/397
5,806,730 A * 9/1998 Deno ..... 224/148.6
5,823,486 A * 10/1998 Smith et al. ..... 248/104
5,967,345 A * 10/1999 Subotin ..... 211/119.007

(Continued)

*Primary Examiner* — Monica Millner
(74) *Attorney, Agent, or Firm* — Israel Nissenbaum; Yitzy Nissenbaum

(57) ABSTRACT

A method and device for providing a child in a crib, with self-access to a feeding bottle containing feeding fluid therein with elevated/cooled temperature of the feeding fluid being retained. An open top retaining receptacle, for the feeding bottle, is provided of an inner dimension suitable for accepting and retaining a baby baffle therein for child removal of the bottle by either lining or tilting and dragging it out. Releasable fastening element or elements enable the retaining receptacle to be securely fastened to one or more fixed position crib elements to fixedly hold the retaining receptacle in an upright position at a position in the crib adjacent and accessible to a child placed therein and a separate heatable or coolable insert element with integrated removal facilitating structure is placed within the retaining receptacle, below and/or around the bottle to maintain heating/cooling temperature of the feeding fluid.

20 Claims, 10 Drawing Sheets

(56) References Cited

U.S. PATENT DOCUMENTS

| | | | | |
|---|---|---|---|---|
| 6,056,246 | A * | 5/2000 | Argy, II | 248/103 |
| 6,134,894 | A * | 10/2000 | Searle et al. | 62/62 |
| 6,145,715 | A * | 11/2000 | Slonim | 224/148.3 |
| 6,286,798 | B1 * | 9/2001 | Chun | 248/311.2 |
| 6,330,808 | B1 * | 12/2001 | Kouwenberg et al. | 62/372 |
| 6,758,453 | B1 * | 7/2004 | Ralko | 248/311.3 |
| 6,786,345 | B2 * | 9/2004 | Richards | 215/11.5 |
| 6,896,231 | B1 * | 5/2005 | Sullivan, Sr. | 248/311.2 |
| 7,010,935 | B2 * | 3/2006 | Citrynell et al. | 62/457.3 |
| 7,472,871 | B1 * | 1/2009 | Demontegnac | 248/104 |
| 7,677,407 | B2 * | 3/2010 | Davis | 220/739 |
| 7,770,410 | B2 * | 8/2010 | Cote | 62/457.4 |
| 7,793,904 | B2 * | 9/2010 | Scarton et al. | 248/311.2 |
| 7,976,088 | B1 * | 7/2011 | Diciolla | 294/154 |
| 8,256,411 | B2 * | 9/2012 | Christy | 126/263.01 |
| 8,534,345 | B1 * | 9/2013 | French et al. | 165/10 |
| 2006/0081747 | A1 * | 4/2006 | Sherman et al. | 248/309.1 |
| 2006/0213205 | A1 * | 9/2006 | Reverendo | 62/3.3 |
| 2008/0169688 | A1 * | 7/2008 | Funderburg | 297/188.06 |
| 2010/0000980 | A1 * | 1/2010 | Popescu | 219/201 |
| 2010/0005828 | A1 * | 1/2010 | Fedell | 62/457.4 |

* cited by examiner

CRIB BABY BOTTLE HOLDER FOR SELF FEEDING

This is a continuation in part of co-pending U.S. patent application Ser. No. 13/623,092 filed Sep. 19, 2012, the entire disclosure of which is incorporated herein by reference thereto.

FIELD OF INVENTION

This invention relates to systems and methods for holding a baby bottle that is used for self-feeding babies and toddlers and particularly to safe methods for baby self feeding and for maintaining warmth or cooling of feeding fluid contained in the baby bottle prior to self feeding use.

BACKGROUND OF THE INVENTION

Baby bottles are generally available in several relatively standard volume sizes of about three to four ounces, usually used for infants, and larger eight to nine ounce bottles, usually used by older children for holding larger amounts of liquids, such as formula, milk, juices or water. The larger baby bottles, available from many sources, are roughly elongated and cylindrical in form, with it height of about seven inches and a diameter of about two to three inches; a size that young children are comfortable handling. When a child is able to hold and drink from a bottle by itself, an adult generally gives the child the bottle, almost invariably of the larger size, when it demands a drink.

There are numerous devices available for holding baby bottles, which are often insulated and generally, grippingly hold the bottle itself or are receptacles for holding the bottle. Such holders, however, are adapted, placed and configured for storage utilization by an adult. With such utilization either the bottle itself or a receptacle that holds the bottle is held by a strap or other holding element attached to a stroller, chair or other convenient location for keeping a bottle handy for the adult to provide to the child for feeding. As far as is known, no baby bottle holder, however, is available which is adapted for self-feeding use by the child in a crib as used herein, the term "crib" also includes any enclosure for a child such as a playpen, carriage, bed with bed-guard and the like).

SUMMARY OF THE INVENTION

In the parent application hereof, a method, holding system and device were described to enable a child to feed itself without the helping presence of an adult. Children of a general age of up to about three or four years old sleep in cribs or similar protected enclosures. They are therefore unable, whether as a factor of extreme youth or as a result of their being confined in an enclosure, to obtain a bottle for feeding on their own. Accordingly, they are either directly fed by an adult or are given a bottle on demand (usually by crying). Simply placing a feeding bottle into a crib, however, is of little merit. It would be unreasonable to expect a child, often in a sleep-like stupor, to search his or her crib, often in total darkness, for his or her bottle. Furthermore, standing an elongated and cylindrical shaped bottle onto a soft and irregular surfaced mattress, which is constantly being nudged by the movement of the child thereon, would most likely cause the bottle to fall onto its side, roll about the crib and leak. The resulting moisture may cause discomfort or wake the child, soil the crib sheet or spoil and thus harbor germs. In accordance with the present invention, a designated and set location is able to be established for a child to intuitively and consistently check for his or her bottle while ensuring that the bottle will stand erect therein throughout. In addition, while the bottle is in the crib under ambient temperature conditions, additional provisions are made herein to partially maintain warmth or coolness of the bottle's contents for as long as is practical.

In accordance with the method described in the parent application and as described herein, a child in a crib is provided with access to a feeding bottle in the crib by the steps of:

a. preparing a retaining receptacle with an open top and of an inner dimension suitable for accepting and retaining a baby bottle therein with minimal effort required to remove it front the receptacle through the open top by either lifting or tilting and dragging; and
b. providing the retaining receptacle with a releasable fastening element or elements, such as hook and eye fasteners of a length and number sufficient to enable the retaining receptacle to be securely fastened to one or more fixed elements, such as upright bars, slats or the frame of a crib to fixedly hold the retaining receptacle in an upright position; and
c. fastening the bottle retaining receptacle to the inside of the crib by means of the fastening element or elements at a position of the crib adjacent and accessible to a child placed therein, within the child's reach; and
d. placing a bottle containing feeding fluid within the receptacle, whereby a child is able to remove the bottle from the receptacle to enable it to self feed itself.

In accordance with the present invention, the method of the prior application is supplemented with an additional step and element for use in the additional step for maintaining the warm or cool temperature of the feeding fluid for an increased period of time beyond that obtainable with the simple use of insulation:

e. placing a chilled or heated insert (depending on whether coolness or warmth is to be maintained respectively) into the receptacle at a position beneath or peripheral to the bottle with feeding fluid therein prior to or with the placement of the bottle into the receptacle (e.g., prior to step d).

The temperature of the insert is lowered or elevated as desired by placing it into a refrigeration unit (e.g. refrigerator or freezer) or a heating unit (e.g., microwave) for it period of time sufficient to reach a desired cooling or warming temperature respectively. It is understood that the cooling or warming temperature is limited to a temperature that would not he detrimental to a child that may come in contact with the insert. Generally, up to about a 25° C. temperature deviation from ambient (20-25° C.) is both effective and safe. The appropriateness of the insert temperature may be manually tested prior to use in a manner akin to testing the temperature of the feeding fluid (e.g., wrist skin testing).

Other objects, features and advantages of the present invention will become more evident from the following discussion and drawings in which:

SHORT DESCRIPTION OF THE DRAWINGS

DETAILED DESCRIPTION OF THE INVENTION

Figure 1:
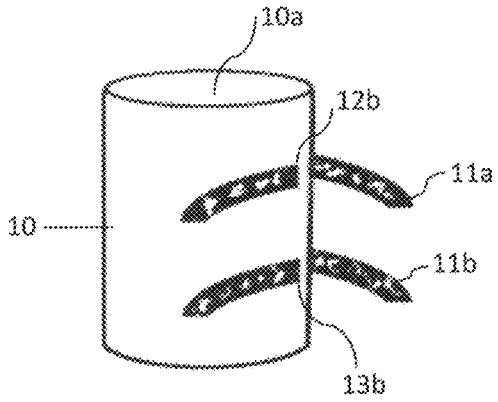
FIG. 1 is a perspective side view of the bottle receptacle with strips of a hook and eye fastener being threaded into slots therein.

The receptacle, since it is placed directly within the crib, should be of a soft and durable, non-toxic material, which would not harm the child if the child either bumps into it while sleeping or attempts to gnaw on it. In one embodiment, the receptacle should be rounded, without corners, and should be soft and not constructed of a hard material such as rigid plastic. Hard materials may, however, be utilized if they are securely covered with a padded element which cannot be removed by the child. In some embodiments, the material is selected to have insulating characteristics in order to maintain freshness of content, even when a bottle is retained therein for prolonged periods. A suitable material for the receptacle is a resilient, non-toxic foam, vinyl, silicon or rubber based material, with the receptacle most commonly, though not necessarily, being cylindrical in shape.

The releasable fastening element or elements should be short enough and have sufficient hulk to prevent entanglement with the child and also not present any type of choking hazard should it work loose. For safety considerations, the fastening clement should also not be readily detachable from the receptacle nor should it have detachable small parts such as buttons or clips. An example of such a fastener is a length of dual sided hook and eye fastener on a fabric base. To attach the fastener to the receptacle the fastener may be drawn through parallel closely spaced longitudinal slots in the side of the receptacle, or alternatively, a rivet engagement may he used to permanently secure the fastener to the receptacle.

The inner height of the receptacle should be sufficient to retain a bottle therein without tipping, but should not be excessively high whereby it may prevent or retard the child from removing the bottle contained therein. Generally, the inner height of the retaining receptacle is in a range of between about one third to about two thirds the height and preferably about half the height of a standard seven inch bottle (i.e., between about a little more than two and a half inches to about five and a quarter inches in height and preferably about three and a half inches in height). The height is adjustable in accordance with the height of an insert placed within the receptacle in order to maintain non-tipping stability.

The diameter of the aperture of the receptacle area should be generously more than the diameter of the bottle itself, in contrast to standard insulating bottle holders, which generally provide a snug fit. A similar snug fit with the bottle receptacle would tend to retard bottle removal from the receptacle by children unable to lift a bottle out of the receptacle, but who tilt and drag the bottle from the receptacle. An inner diameter of between about 2.5 to 3.25 inches is most useful, to permit easy removal of the bottle, while preventing the bottle from being accidentally dislodged, and while retaining its insulating qualities.

The insert, in one embodiment, is comprised of a water pack or gel pack (generally a combination of water and cellulose with appropriate preservatives) made of a soft plastic such as EVA (ethylene-vinyl-acetate) or rubberized no-toxic material such as silicone. It should also be resistant to tearing and teething by a child who may be able to remove it from the receptacle. To maximize effectiveness, the insert is sized to snugly fit, though not tightly fit, into the receptacle adjacent the bottom thereof and optionally configured to also snugly fit along the inner sidewalls of the receptacle. A torus or disc form, with optional side wall extensions along the perimeter, may provide more heating or cooling capability for a cylindrical receptacle.

The dimensions of the insert are set to prevent excessive raising of the bottle within the receptacle. In one embodiment, the suitable height dimensions of the insert, for use with standard size feeding bottles, generally ranges up to about one and a quarter inches in height with the height of the receptacle being concomitantly adjustable. The internal capacity of the insert, as a water or gel pack should be sufficient to contain enough fluid to maintain a desired temperature for a prolonged time. To retain the desired temperature, periodic replacement or supplementation of the insert may be needed with either another insert or with reheating/recooling of the original insert.

The internal capacity of the insert, as a gel or water pack should be sufficient to contain enough fluid to maintain a desired temperature for a predetermined period of time. The insert should have structural elements, which permit it to be readily removed from the receptacle. Examples of such structural elements include an integral tab that can be grasped and lifted or the insert can be shaped as a doughnut, whereby as finger can be inserted into the hollow center and removed.

The device of the present invention, as used in the method of permitting self feeding by a child confined in a crib, and a temperature maintenance of the feeding fluid in the bottle, comprises a receptacle for holding a baby bottle and a heatable/coolable insert configured for placement within the receptacle, with the walls of the receptacle being spaced from the bottle for a sufficient distance for the bottle to he tilted and dragged out of the receptacle by the child. The height of walls of the receptacle in conjunction with the degree of spacing of the bottle from the walls of the receptacle is sized to permit the tilting and drag out removal of the bottle from the receptacle with minimal impedance. The height of the receptacle should be at least sufficient to prevent the bottle from too easily toppling out. It is understood that different elements may be utilized for the heating and the cooling in addition to a single element capable of retaining warmth or maintaining coolness.

Figure 2:
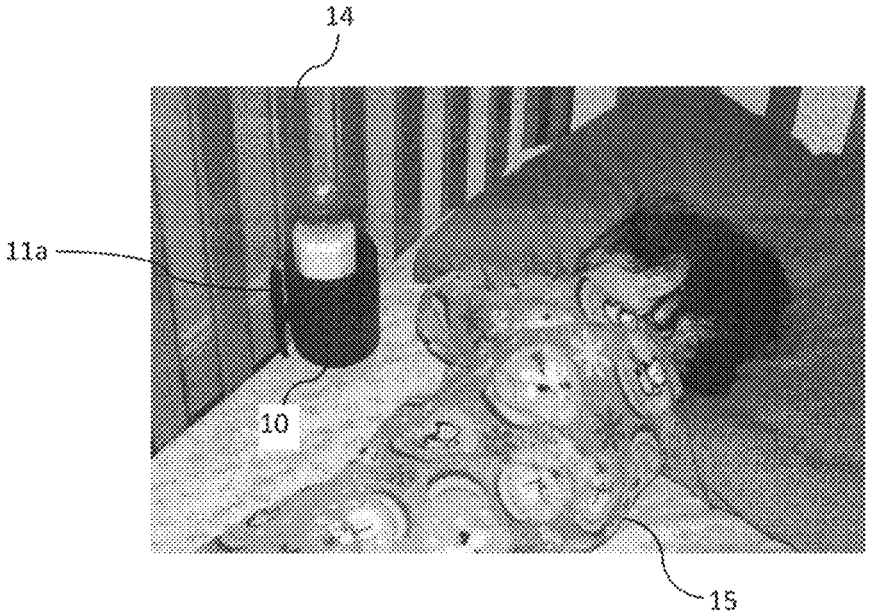
FIG. 2 is a view of the inside of a crib with a child therein, showing the placement of the bottle receptacle with a bottle at a position accessible by the child for removal of the bottle.
Figure 4:
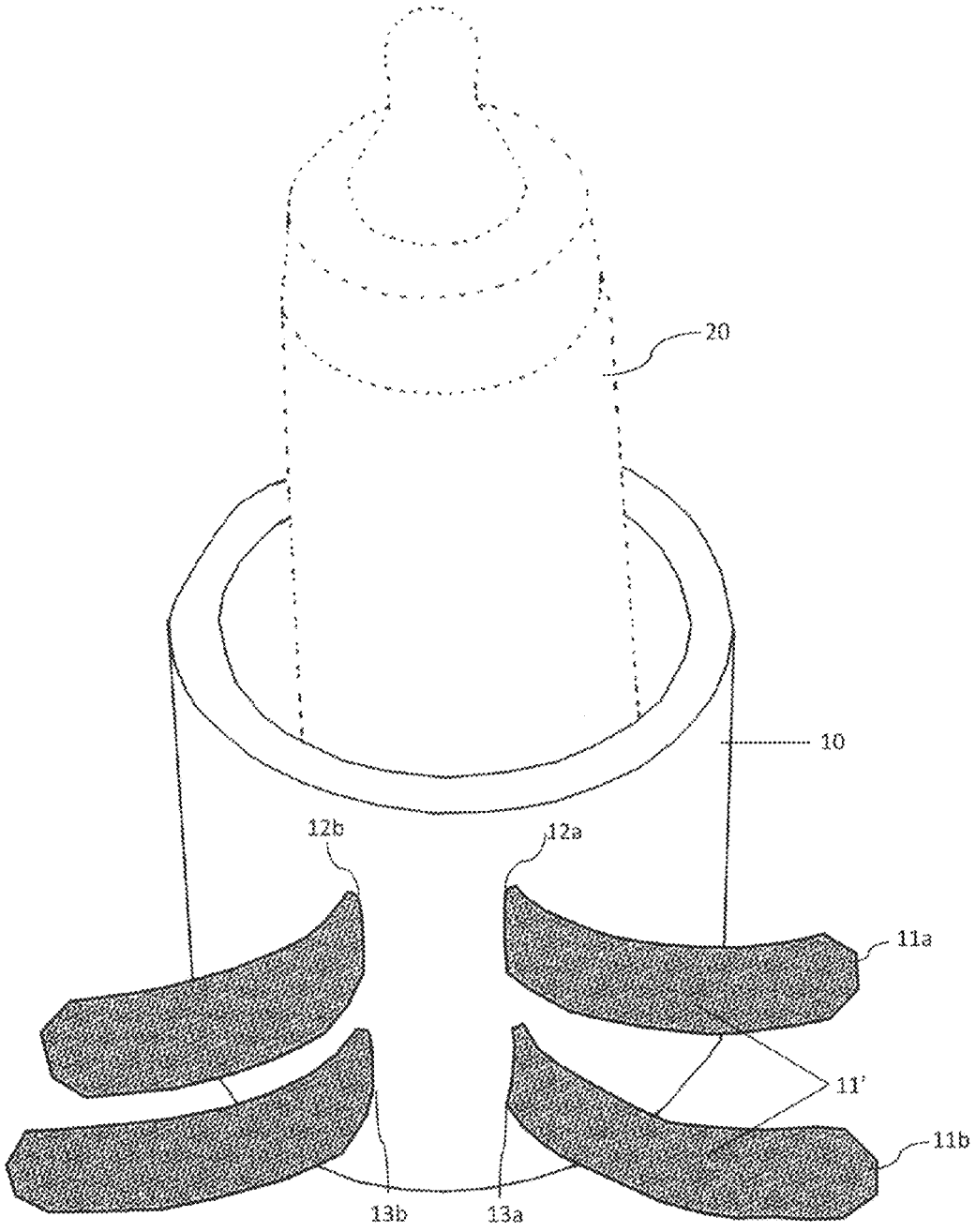
FIG. 4 is a rear perspective top view of the bottle in the bottle receptacle of FIG. 3.

With specific reference to the drawings, a baby bottle receptacle 10, with a rounded configuration tor safety, is shown in FIG. 1, with an open top 10*a* into which a bottle is insertable. As shown in FIG. 4, two hook and eye strips 11*a* and 11*b* having hooks on one side and cooperative eyes on the other arc each respectively drawn through a pair of slit apertures 12*a*,12*b* and 13*a*, 13*b*, in bottle receptacle 10. As shown in FIG. 2, the receptacle 10 is fastened by means of the hook and eye strips to a slat 14 of a crib at a position within arms reach of sleeping child 15, in a position convenient for self feeding by the child. Only a rounded protrusion extends into the crib and with a soft exposed contact area.

Figure 3:
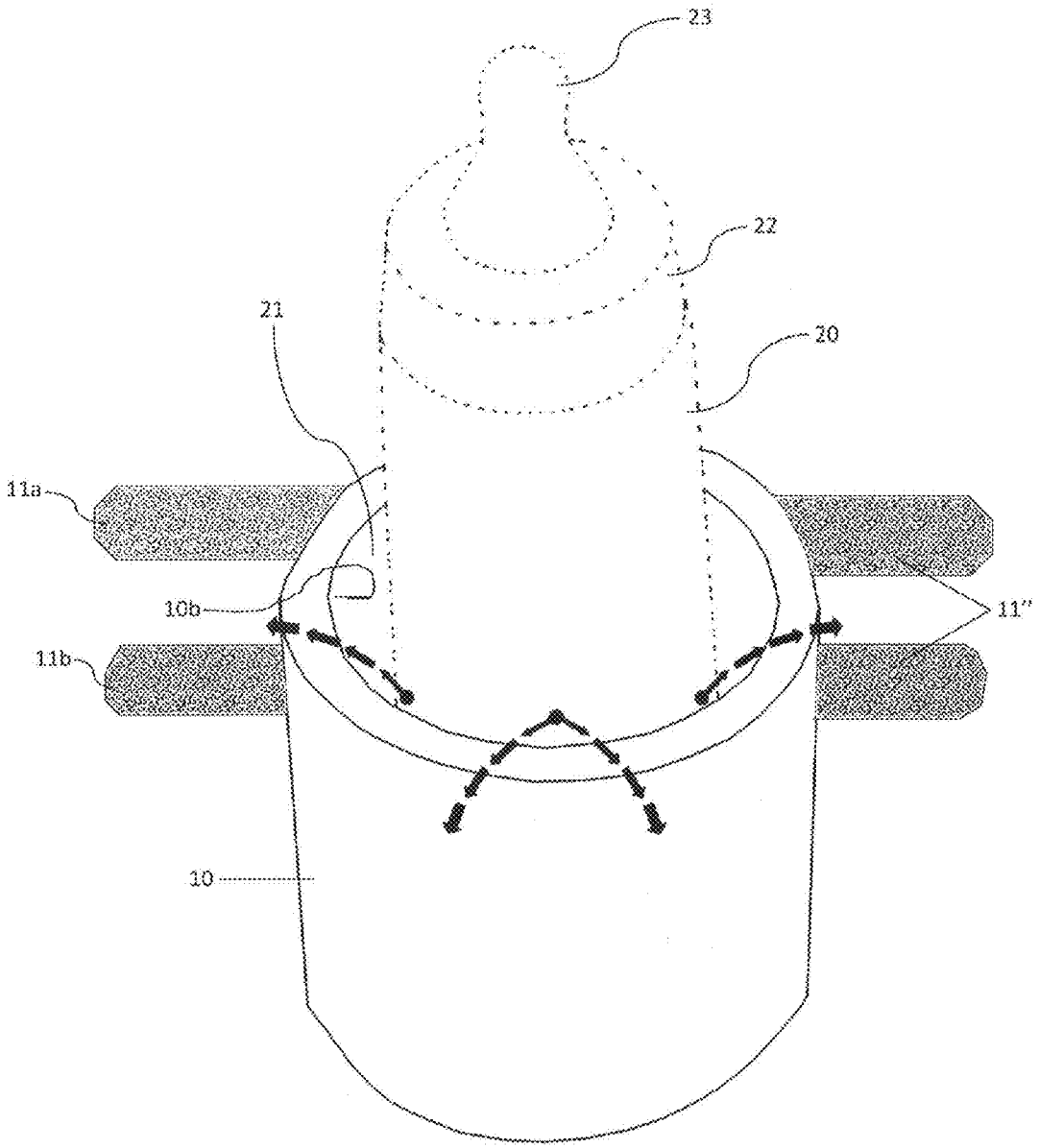
FIG. 3 is a front perspective view from above showing the bottle in dotted lines as placed initially in the bottle receptacle.

In FIG. 3, the rounded receptacle 10 is shown as containing baby bottle 20, with the bottle 20 being spaced from the inner walls of the receptacle 10*b* with about a half inch spacing 21 on either side and wherein the inner height of the walls of the receptacle H is about half of the height H' of the fluid containing bottle (not counting the height of the nipple 23), whereby the bottle 20 earl he tilted in the direction shown by the arrows and dragged out by the child of the receptacle 10.

Figure 5:
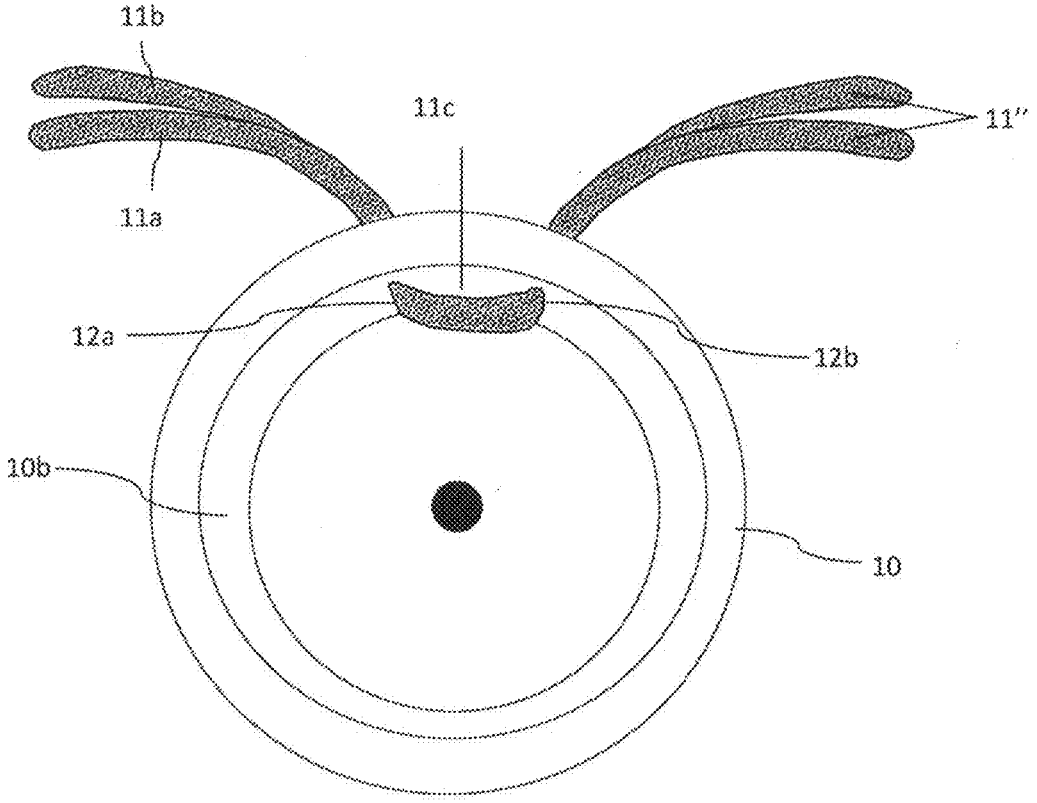
FIG. 5 is a top view of FIG. 3 without the bottle.
Figure 6:
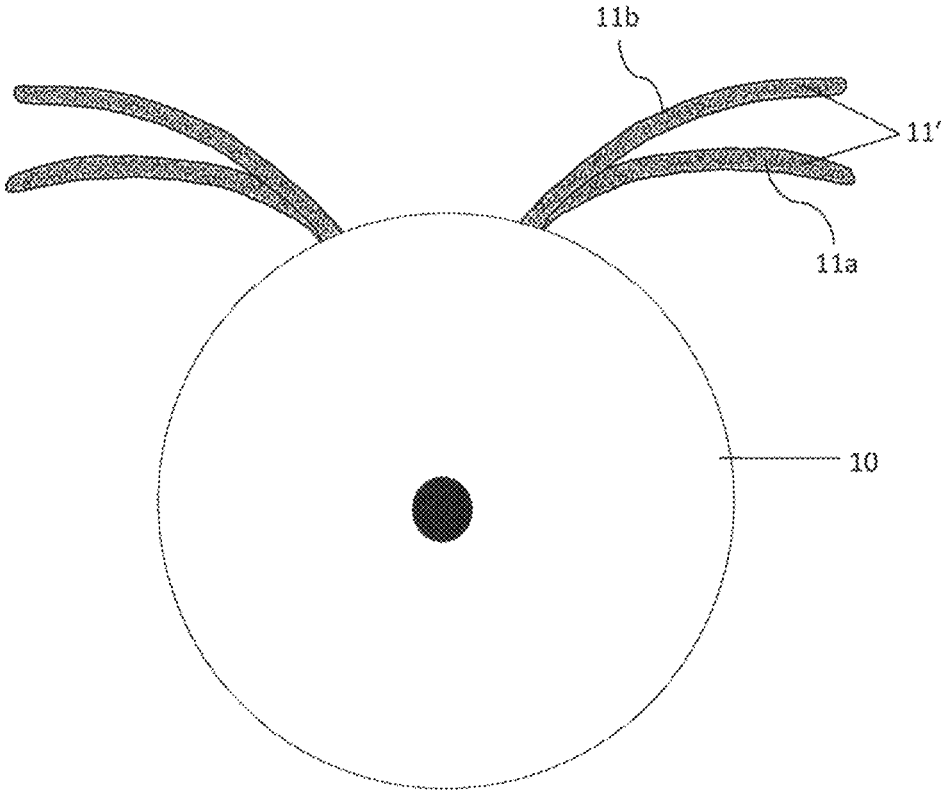
FIG. 6 is a bottom view of FIG. 3 without the bottle.

As is more dearly evident from FIGS. 3-6, the hook and eye straps 11*a* and 11*b* extend through the slit aperture pairs 12*a*, 12*b* and 13*a*, 13*b* respectively, and extend for a short distance beyond the outer perimeter of receptacle 10. As seen in FIG. 5, neither of the hook and eye straps 11*a* and 11*b* are attached to an anchoring base and integrally provide their own base with the interleaved segment 11*c* which bears against the inner surface 10*b* of the receptacle wall to provide the anchoring to the crib bar, slat, or frame.

Figure 7:
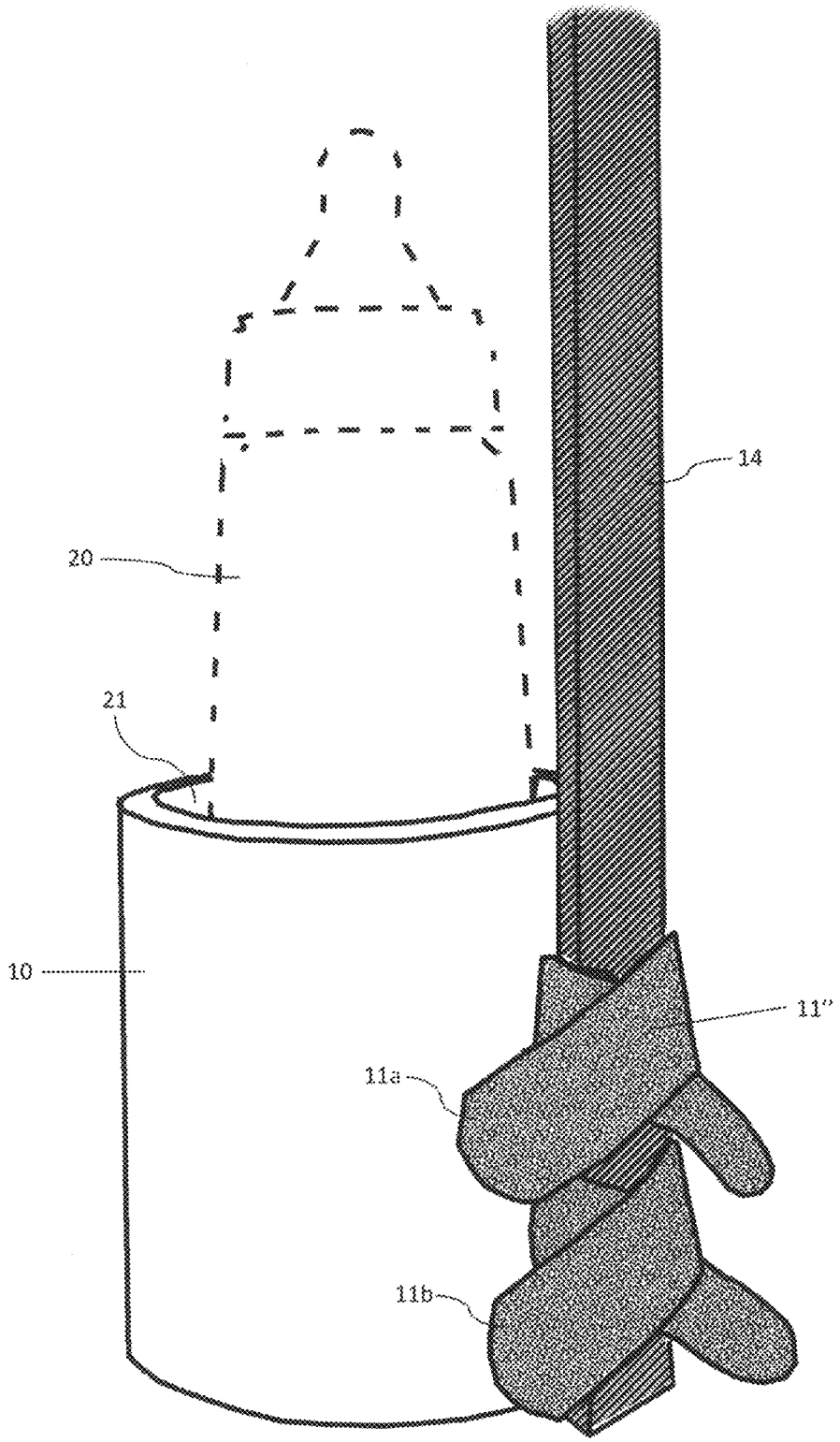
FIG. 7 is a perspective side view of the bottle and holder of FIG. 3 as being fastened to a bar of a child's crib.
Figure 8:
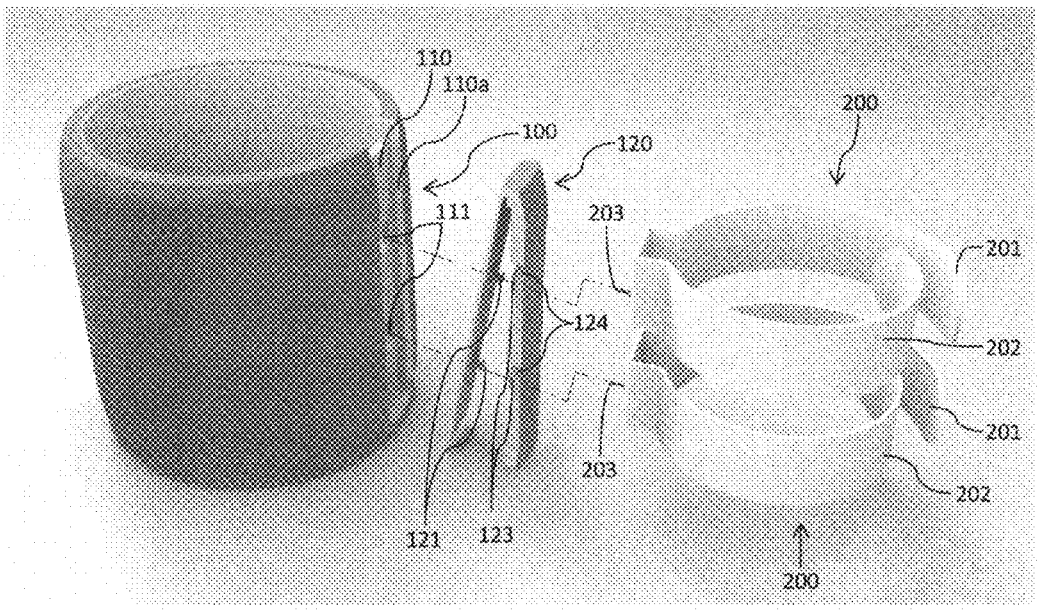
FIG. 8 is a separated view of an alternative attachment with a rivet structure that secures the fastener to the bottle receptacle.

FIG. 7 shows the releasable hook and eye connection of straps 11*a* and 11*b* by the overlapping engagement of the hooks of one side of the strap with the eyes of the other side. It is, of course, understood, that such engagement may be replaced by other engagement means such as a belt type or a simple ribbon bow.

FIG. 1 shows an alternative rivet-like structure embodiment for fastening bottle receptacle 100 to a crib (not shown). The bottle receptacle is provided with a vertical cut-out section 110*a* with a residual apertured base section 110 having apertures 111. Folding like element 120 comprised of hardened plastic is provided with a pair of snap fitting rivet elements 121 and 123. Element 120 is also provided with cutouts 124, configured and sized to accommodate sections 203 of crib fastening elements 200. The hastening elements 200 are connected to the bottle receptacle 100 by fitting sections 203 (though not shown, sections 203 are apertured for interfitting of rivet elements 123 therethrough) into cutouts 124. The elements 200 and 120 are fitted, as a unit unto apertured base section 110 and is fitted into cutout 110*a* and rivet elements 121 and 123 are snapped together through apertures 111 and through apertures 203 of element 200 to effect the fastening between the bottle receptacle 100 and the fastener elements 200 with hook and eye fastening segments 201 and 202, locked therein by rivet-like structure 120.

Figure 9:
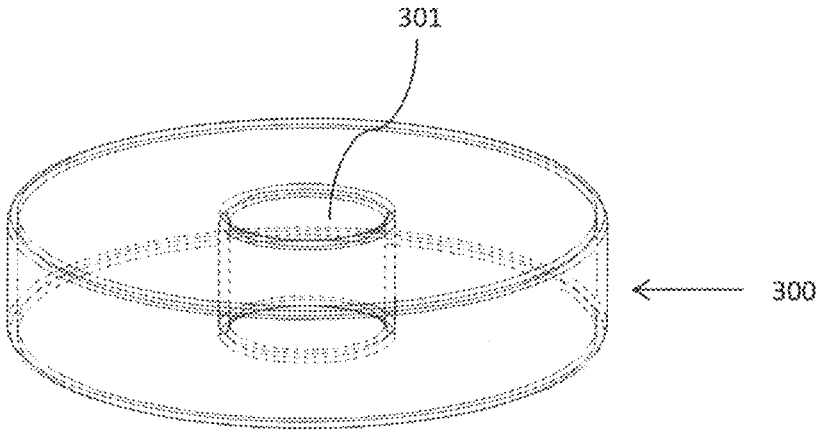
FIG. 9 depicts a configuration of the heating/cooling insert with an optional aperture for facilitated finger removal of the insert from the bottle receptacle.
Figure 10:
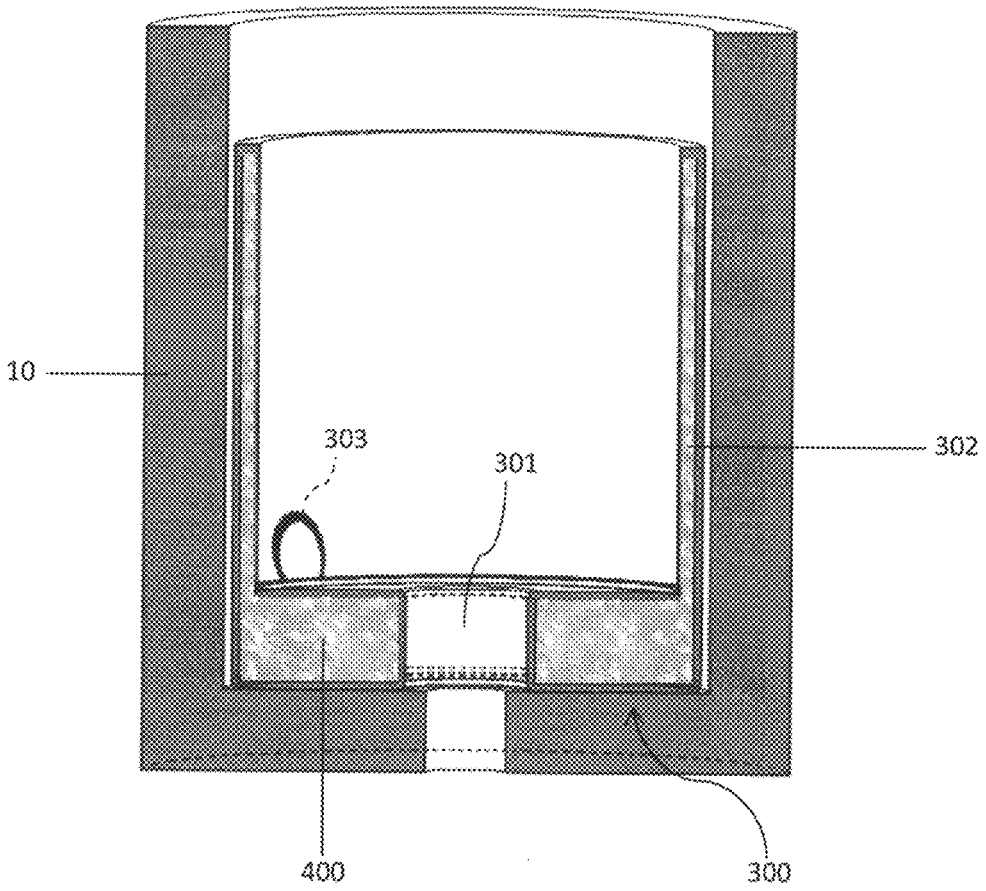
FIG. 10 shows a cutaway of the baffle receptacle showing the insert of FIG. 9, as positioned therewithin, and with optional tab removal structure and sidewall heating/cooling extension.

The heating/cooling insert 300 is shown in FIGS. 9 and 10 as an apertured disc with an internal hollow and a finger fitted aperture 301. FIG. 10 shows the placement of insert 300 within the bottle receptacle IOU and resting on an internal base thereof Fluid 400 within insert 300 is heated or cooled to provide the requisite temperature maintenance for a bottle with feeding fluid placed into the bottle receptacle.

Removal tab 303 is shown as being optionally integrated with the insert 300 and it may be used instead of or alternatively with the finger fitting aperture 301 for removal/placement positioning of the insert 300. Also shown is optional side wall extension 302 to provide lateral heating/cooling from the fluid 400 contained therein. It is understood that reduction in diameter effected by the side wall extension is compensated for in the overall dimensions of the receptacle 100 to provide the requisite spacing for removal of the bottle from the receptacle.

It is understood that the above description and drawings are merely exemplary of the present invention and that changes may be made in the structure of the device and system and the method of its use without departing from the scope of the invention as defined in the following claims.

What is claimed is:

1. A method for providing a child in an enclosure with self access to an elongated feeding bottle, with the enclosure comprising:

at least one side enclosure wall comprised of at least one vertically extending bar element, and containing a horizontally positioned mattress perpendicularly positioned adjacent a base of the at least one side enclosure wall, with a bottle retaining receptacle having an open top, releasably fastened to fixed position elements in the enclosure and positioned for a closed bottom of the bottle retaining receptacle to be supported on the mattress to be in a stable upright position in the enclosure, and configured to be accessible to a child placed in the enclosure for removal of the bottle by the child from the bottle retaining receptacle, with feeding fluid therein maintained at a desired elevated or cooled temperature, comprising the steps of:

(a) heating or cooling a temperature maintaining insert to the desired temperature, (b) placing the temperature maintaining insert into the bottle retaining receptacle, (c) placing the bottle retaining receptacle onto the mattress within the enclosure for support thereof on the mattress at a position accessible to the child and releasably affixing the bottle retaining receptacle to the enclosure in a stable upright position with a releasable fastening element;

(d) placing the bottle into the bottle retaining receptacle into thermal proximity to the insert in an upright position wherein the heated or cooled insert further maintains a desired elevated or cooled temperature respectively of the feeding fluid for a requisite period of time and wherein the insert is shaped to fit into the bottle retaining receptacle at a position adjacent the bottle placed therein.

2. The method of claim 1, wherein the insert is heated or cooled, as desired, to a temperature which deviates from ambient temperature by up to 25° C.

3. The method of claim 2, wherein the insert is cooled by keeping it in a refrigerator or freezer for a time sufficient to attain a desired temperature up to 25° C. below ambient.

4. The method of claim 2, wherein the insert is heated by being placed in a microwave for a time sufficient to attain a desired temperature of the insert up to 25° C. above ambient.

5. The method of claim 1, wherein the insert comprises is a shape of one of a disc, a doughnut shaped torus with a central aperture, a cylindrical sleeve, and a combination of the cylindrical sleeve and the disc or torus, with the insert sized to fit within the inner dimension without impeding positioning and maintaining positioning of the bottle within the bottle receptacle, for the removal of the bottle from the bottle receptacle by the child.

6. The method of claim 5, wherein the insert is provided with an integral element, which is configured to facilitate removal of the insert from the bottle receptacle by an adult.

7. The method of claim 2, wherein the insert is comprised of a non-toxic material containing a non toxic temperature retention fluid material therewithin, with the material of the insert being sufficiently durable to contain the non-toxic temperature retention fluid during heating or cooling to the 25° C. deviation from ambient temperature and to resist tearing or puncturing by the child.

8. The method of claim 7, wherein the non toxic material is one of EVA and silicone and the fluid material is comprised of water or a water gel composition.

9. The method of claim 1, wherein the releasable fastening element is permanently connected to the bottle receptacle with a snap rivet connection.

10. A device and an enclosure to which the device is releasably attached for enabling a child placed in the enclosure to self feed from a bottle having feeding fluid kept at desired temperatures deviating from ambient temperature up to 25° C., with the enclosure comprising at least one side enclosure wall comprised of at least one vertically extending bar element, and containing a horizontally positioned mattress perpendicularly positioned adjacent a base of the at least one side enclosure wall, and the device comprising:

a) a bottle retaining receptacle with a receptacle retaining portion having an open top and an inner dimension of the retaining portion suitable for accepting and retaining the bottle with feeding fluid;

b) a releasable fastening element or elements integrally attached to the bottle retaining receptacle with which the retaining receptacle is releasably fastened in an upright stable position to the enclosure by means of the fastening element or elements and supported by the mattress at a position adjacent to and accessible to a child placed on the mattress and within the enclosure, whereby the child is able to remove the bottle from the receptacle to enable it to self feed itself; wherein the bottle retaining receptacle comprises at least two apertures in a wall thereof and wherein the releasable fastening element or elements comprise at least one fastening strap with the at least one fastening strap being drawn into the bottle retaining receptacle through one aperture and out of the bottle retaining receptacle through another aperture to effect the integral attachment between the releasable fastening element or elements and the bottle retaining receptacle, and c) a separate temperature maintaining insert placed into the bottle retaining receptacle prior to placement of the bottle therein, wherein the insert is heated or cooled prior to the placement thereof in the bottle retaining receptacle and placed within the bottle retaining receptacle in thermal proximity to the bottle placed in the bottle retaining receptacle, wherein the heated or cooled insert maintains a desired elevated or cooled temperature respectively for a requisite period of time, and wherein the insert is shaped to fit into the bottle retaining receptacle at a position adjacent the bottle inserted therein.

11. The device of claim 10, wherein the insert comprises a shape of one of a disc, a doughnut shaped torus with a central aperture, a cylindrical sleeve, and a combination of the cylindrical sleeve and the disc or torus, with the insert sized to fit within the inner dimension without impeding positioning and maintaining positioning of the bottle within the bottle receptacle, and the removal of the bottle from the bottle receptacle by the child.

12. The device of claim 10, wherein the insert is provided with an integral element, to facilitate removal of the insert from the bottle receptacle.

13. The device of claim 10, wherein the insert is comprised of a non-toxic material containing a non toxic temperature retention fluid material therewithin, with the material of the insert being sufficiently durable to contain the non-toxic temperature retention fluid during heating or cooling to the 25° C. deviation from ambient temperature and to resist tearing or puncturing by the child.

14. The device of claim of claim 13, wherein the non toxic material is one of EVA and silicone and the fluid material is comprised of water or a water gel composition.

15. The device of claim 10, wherein the bottle retaining receptacle is comprised of a thermal insulation material configured to provide additional retention of the elevated or cooled temperature.

16. The method of claim 1, wherein the insert is provided with elements thereof positioned between the inserted bottle and inner walls of the bottle retaining receptacle and spaced below the open top by a distance sufficient to retard removal of the insert by the child from the bottle retaining receptacle after removal of the bottle therefrom.

17. The device of claim 10, wherein the insert is provided with elements thereof positioned between the inserted bottle and inner walls of the bottle retaining receptacle and spaced below the open top by a distance sufficient to retard removal of the insert by the child from the bottle retaining receptacle after removal of the bottle therefrom.

18. The device and enclosure of claim 10, wherein the enclosure is a crib.

19. The device of claim 18 wherein the bottle retaining receptacle is releasably affixed to a bed-guard within the crib whereby the bottle retaining receptacle is affixed to the crib in a stable upright position within the crib.

20. A device and an enclosure to which the device is releasably attached for enabling a child placed in the enclosure to self feed from a bottle having feeding fluid kept at desired temperatures deviating from ambient temperature up to 25° C., with the enclosure comprising at least one side enclosure wall comprised of at least one vertically extending bar element, and containing a horizontally positioned mattress perpendicularly positioned adjacent a base of the at least one side enclosure wall, and the device comprising:

a) a bottle retaining receptacle with a receptacle retaining portion having an open top and an inner dimension of the retaining portion suitable for accepting and retaining the bottle with feeding fluid;

b) a releasable fastening element or elements integrally attached to the bottle retaining receptacle with which the retaining receptacle is releasably fastened in an upright stable position to the enclosure by means of the fastening element or elements and supported by the mattress at a position adjacent to and accessible to a child placed on the mattress and within the enclosure, whereby the child is able to remove the bottle from the receptacle to enable it to self feed itself; wherein the releasable fastening element or elements comprises at least one strap element and a clip comprising two leg elements connected at one end and the clip having an open other end for placement over a wall of the bottle retaining receptacle and the fastening element and the clip longitudinally enclosing a substantial length of a section of a wall of the bottle retaining receptacle and a section of the at least one strap element and wherein the enclosed sections of the wall and the at least one strap element are apertured in alignment with each other and wherein the clip comprises integral extension elements which are aligned with the apertures in the bottle retaining receptacle and the at least one strap element, the extension elements passing through the aligned apertures and fasten the legs of the clip together to effect the integral attachment between the releasable fastening element and the bottle retaining receptacle, and c) a separate temperature maintaining insert placed into the bottle retaining receptacle prior to placement of the bottle therein, wherein the insert is heated or cooled prior to the placement thereof in the bottle retaining receptacle and placed within the bottle retaining receptacle in thermal proximity to the bottle placed in the bottle retaining receptacle, wherein the heated or cooled insert to maintains a desired elevated or cooled temperature respectively for a requisite period of time, and wherein the insert is shaped to fit into the bottle retaining receptacle at a position adjacent the bottle inserted therein.

* * * * *